US006630434B2

(12) United States Patent
Besse et al.

(10) Patent No.: US 6,630,434 B2
(45) Date of Patent: Oct. 7, 2003

(54) THICKENED HARD SURFACE CLEANER

(75) Inventors: Michael E. Besse, Golden Valley, MN (US); Richard O. Ruhr, Buffalo, MN (US); Gerald K. Wichmann, Maple Grove, MN (US); Timothy A. Gutzmann, Eagan, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/862,188

(22) Filed: May 21, 2001

(65) Prior Publication Data

US 2002/0082178 A1 Jun. 27, 2002

Related U.S. Application Data

(62) Division of application No. 08/369,303, filed on Jan. 6, 1995, now Pat. No. 6,268,324, which is a continuation of application No. 08/070,000, filed on Jun. 1, 1993, now abandoned.

(51) Int. Cl.[7] ..... C11D 1/62; C11D 1/75

(52) U.S. Cl. ..... 510/197; 510/202; 510/210; 510/218; 510/220; 510/234; 510/237; 510/247; 510/253; 510/384; 510/503; 510/504

(58) Field of Search ..... 510/197, 202, 510/210, 218, 220, 234, 237, 247, 253, 384, 503, 504

(56) References Cited

U.S. PATENT DOCUMENTS

| | | | | |
|---|---|---|---|---|
| 3,211,659 | A | | 10/1965 | Pikaar |
| 3,440,063 | A | | 4/1969 | Chestochowski et al. |
| 3,496,110 | A | | 2/1970 | Shumway et al. |
| 3,523,826 | A | | 8/1970 | Lissant |
| 3,684,722 | A | | 8/1972 | Hynam et al. |
| 3,882,038 | A | * | 5/1975 | Clayton et al. ..... 252/164 |
| 3,943,234 | A | | 3/1976 | Roggenkamp |
| 3,993,575 | A | | 11/1976 | Howanitz et al. |
| 4,105,574 | A | * | 8/1978 | Culmone et al. ..... 252/154 |
| 4,238,345 | A | | 12/1980 | Guibert |
| 4,337,163 | A | | 6/1982 | Schilp |
| 4,372,788 | A | * | 2/1983 | Lancz ..... 134/4 |
| 4,388,204 | A | | 6/1983 | Dimond et al. |
| 4,399,050 | A | | 8/1983 | Benthan et al. |
| 4,421,664 | A | | 12/1983 | Anderson et al. |
| 4,474,677 | A | | 10/1984 | Foxlee |
| 4,501,680 | A | | 2/1985 | Aszman et al. |
| 4,540,506 | A | | 9/1985 | Jacobson et al. |
| 4,576,728 | A | | 3/1986 | Stoddart |
| 4,587,032 | A | | 5/1986 | Rogers |
| 4,588,514 | A | | 5/1986 | Jones et al. |
| 4,699,728 | A | | 10/1987 | Riehm et al. |
| 4,743,395 | A | | 5/1988 | Leifheit |
| 4,753,754 | A | | 6/1988 | Messenger et al. |
| 4,753,755 | A | | 6/1988 | Gansser |
| 4,770,814 | A | | 9/1988 | Rose et al. |
| 4,783,283 | A | | 11/1988 | Stoddart |
| 4,786,422 | A | | 11/1988 | Kern |
| 4,800,036 | A | | 1/1989 | Rose et al. |
| 4,842,771 | A | | 6/1989 | Rorig et al. |
| 4,846,993 | A | | 7/1989 | Lentsch et al. |
| 4,853,146 | A | | 8/1989 | Rorig et al. |
| 4,857,030 | A | | 8/1989 | Rose |
| 4,888,119 | A | | 12/1989 | Klewsaat |
| 4,900,467 | A | | 2/1990 | Smith |
| 4,919,839 | A | | 4/1990 | Durbut et al. |
| 4,929,367 | A | | 5/1990 | Thomas et al. |

(List continued on next page.)

FOREIGN PATENT DOCUMENTS

| | | |
|---|---|---|
| EP | 0137871 | 10/1983 |
| EP | 0 094 119 | 11/1983 |
| EP | 0129980 | 5/1984 |
| EP | 0 137 871 | 4/1985 |
| EP | 0233666 | 2/1987 |
| EP | 0 253 676 A3 | 1/1988 |
| EP | 0314232 | 10/1988 |
| EP | 0 314 232 | 5/1989 |
| EP | 0 317 066 A3 | 5/1989 |
| EP | 0 595 590 A2 | 5/1994 |
| GB | 948396 | 2/1964 |
| GB | 1240469 | 8/1967 |
| GB | 1349567 | 4/1971 |
| GB | 1548379 | 5/1975 |
| GB | 2012837 | 10/1978 |
| GB | 2185036 | 1/1987 |
| GB | 2190681 | 5/1987 |
| WO | WO 93/02175 | 2/1993 |

OTHER PUBLICATIONS

Rheology of Surfactant Solutions, H. Hoffmannn et al., Journal for Theory, Technology and Application of Surfactants, Tenside Detergents 22 (1985) 6.

(List continued on next page.)

*Primary Examiner*—Charles Boyer
(74) *Attorney, Agent, or Firm*—Merchant & Gould PC

(57) ABSTRACT

A low viscosity aqueous cleaning composition provides increasing viscosity upon dilution which provides a high viscosity diluted cleaning composition having solvents compatible with the rod micelle thickener and the cleaning system that clings for an extended period of time in a thickened form containing cleaning system ingredients that can penetrate and remove hard baked-on soils on vertical surfaces in cleaning units. The composition contains active cleaning ingredients (acid, alkaline and enzyme) that, in combination with thickening systems, provide the useful properties. The thickened materials can be applied on cold or hot surfaces and can successfully penetrate, soften and remove baked-on food soil on a variety of surfaces including oven walls, doors and grills, baking dishes, utensils, etc. The material is applied in the form of a thick diluted liquid spray or hot foam directly to the hardened soil, is permitted to penetrate the soil, resulting softened soils are then easily removed by hot or cold water rinse or by mechanical action such as scrubbing, scraping or wiping.

8 Claims, No Drawings

U.S. PATENT DOCUMENTS

| | | | | | |
|---|---|---|---|---|---|
| 4,935,065 | A | | 6/1990 | Bull | |
| 5,011,538 | A | | 4/1991 | Smith | |
| 5,055,219 | A | | 10/1991 | Smith | |
| 5,076,954 | A | | 12/1991 | Loth et al. | |
| 5,102,573 | A | * | 4/1992 | Han et al. | 252/164 |
| 5,108,643 | A | | 4/1992 | Loth et al. | |
| 5,204,016 | A | * | 4/1993 | Hamilton et al. | 252/162 |
| 5,298,195 | A | | 3/1994 | Brumbaugh | |
| 5,300,250 | A | | 4/1994 | Morgan et al. | |
| 5,302,375 | A | | 4/1994 | Viscio | |
| 5,316,688 | A | | 5/1994 | Gladfelter et al. | |
| 5,364,551 | A | * | 11/1994 | Lentsch et al. | 252/156 |
| 5,460,742 | A | * | 10/1995 | Cavanagh et al. | 252/144 |

OTHER PUBLICATIONS

High Viscosities of Cationic and Anionic Micellar Solutions in the Presence of Added Salts, Consuelo Gamboa and Luis Sepulveda, Journal of Colloid and Interface Science, vol. 113, No. 2, Oct. 1986.

Macro–and Microemulsions Theory and Applications, American Chemical Society Symposium Series 272; Viscoelastic Detergent Solutions From Rodlike Micelles, H. Hoffmann, H. Rehage, K. Reizlein, and H. Thurn.

Counterion Effects on the Aqueous Solution Viscosity of Cationic Surfactants, G.E. Totten, E.D. Goddard, G.H. Matteson and M.L. Wanchisen, JAOCS, vol. 63, No. 12 (Dec. 1986).

Effect of Temperature on the Viscosity of Cationic Mecellar Solutions in the Presence of Added Salts, Luis Sepulveda and Consuelo Gamboa, Journal of Colloid and Interface Science, vol. 118, No. 1, Jul. 1987.

Electrolyte Effects on the Cationic Micelle Catalyzed Decarboxylation of 6–Nitrobenzisoxazole–3–carboxylate Anion, Clifford A. Bunton et al., Journal of the American Chemical Society/95:10/May 16, 1973.

The Interaction of Some Naphthalene Derivatives With a Cationic Soap Below the Critical Micelle Concentration, T. Nash, Journal of Colloid Science 13, 134–139 (1958).

Interactions of Some Aromatic Salts with Hexadecyltrimethylammonium Bromide Micelles. Viscosity, Counterion Binding, and Calorimetric Observations, John W. Larsen et al., J. Org. Chem., vol. 41, No. 18, 1976.

A Highly Specific Effect or Organic Solutes at Low Concentrations on the Structure of CTAB Micelles, John W. Larsen et al., Tetrahedron Letters No. 29, pp. 2663–2666, 1973.

Absorbances of Solutions of Cationic Micelles and Organic Anions, L. Sepulveda, Journal of Colloid and Interface Science, vol. 46, No. 3, Mar. 1974.

Viscoelasticity in Highly Dilute Aqueous Solutions of Pure Cationic Detergents, Journal of Colloid and Interface Science, vol. 57, No. 3, Dec. 1976.

The Influence of Solubilized Additives on Surfactant Solutions with Rodlike Micelles, O. Bayer, H. Hoffmann, W. Ulbricht and H. Thurn, Advances in Colloid and Interface Science, 26 (1986) 177–203.

Use of Short–Chain Alkylarylsulfonates to Control Rheological Properties of Detergents, D. Kunishov et al., Chemical Abstracts, vol. 91, 1979, Abstract No. 22828g.

Acidic Liquid Cleaning Agent, J. Schneider, H. Huettner, H.P. Malecha, D. Petermann, Chemical Abstracts, vol. 105 1986, Abstract No. 174867q.

Dowanol Table, Dow Chemical U.S.A., Midland, Michigan (no date available).

* cited by examiner

THICKENED HARD SURFACE CLEANER

This application is a divisional of U.S. application Ser. No. 08/369,303, filed Jan. 6, 1995 that issued as U.S. Pat. No. 6,268,324 on Jul. 31, 2001. U.S. application Ser. No. 08/369,303 is a continuation of U.S. application Ser. No. 08/070,000, filed on Jun. 1, 1993, now abandoned. U.S. application Ser. No. 08/369,303 is incorporated herein by reference.

FIELD OF THE INVENTION

The invention relates to thickened aqueous cleaning compositions using either an acid cleaning system, an alkaline cleaning system or an enzyme cleaning system. In particular the invention relates to thickened aqueous cleaners that have a rheology or viscosity profile permitting an application to a surface with substantial retention of the cleaning material on a vertical or substantially vertical or inclined surface in a cooking unit soiled with a hard baked-on coating of food residue. The cleaning compositions of the invention contain cleaning and thickening materials that cooperate to permit cleaning and removal of hardened baked-on soils from vertical, substantially vertical or inclined surfaces at low temperature. The compositions provide improved cleaning of food soils containing proteinaceous, carbohydrate, fatty and other soil residues from soiled surfaces. The methods of the invention relate to applying cleaning materials to a vertical, a substantially vertical, or inclined surface at low to moderate temperatures (50° F. to 140° F.) to permit softening of the soil and subsequent soil removal.

BACKGROUND OF THE INVENTION

A great deal of effort has been expended in developing thickened aqueous hard surface cleaning materials. Various viscosity increasing systems, and thickened compositions or cleaning formulations have been attempted. Those skilled in this art recognize that there is a need for the successful production of thickened materials that can maintain an effective concentration of active cleaning materials on a target soil on a vertical or inclined surface for an extended period of time. When made, such thickened cleaners should contain cooperating ingredients that can remove soils that are resistant to conventional cleaners having a short residence time.

Thickened cleaner technology is embodied in a variety of disclosures including for example, Roggenkamp, U.S. Pat. No. 3,943,234, discloses acid liquid cleaners containing emollient thickeners. The emollients are commonly fatty alcohols, glycols or fatty esters. Stoddart, U.S. Pat. No. 4,576,728, teaches aqueous cleaning compositions having shear thinning behavior. The cleaners contain common surfactants and alkali metal hypochlorite bleaches in combination with an aromatic carboxylic acid component. Leifheit, U.S. Pat. No. 4,743,395, teaches thickened hydrochloric acid cleaners for hard surfaces such as porcelain, ceramic tile, etc. The cleaners use thickeners such as alkyl glycinates, alkoxylated tertiary amines, and other related organic thickener compositions. Rose et al., U.S. Pat. No. 4,770,814, teaches non-thixotropic shear stable aqueous cleaners that can be sprayed on hard surfaces. Smith, U.S. Pat. No. 4,900,467, teaches thickened aqueous compositions having viscoelastic properties useful as drain cleaner compositions. The viscosity is adjusted for chlorine control and to ensure that the material is denser than water to enable the cleaner to actively open clogged drains. Durbut et al., U.S. Pat. No. 4,919,839, which focuses on microemulsion liquid detergent materials using amine and other aqueous compositions. Neil et al., European Patent Application No. 314,232, teaches a liquid detergent composition for hard surface cleaning combining a blend of surfactants with other cleaning materials to obtain both acid and alkaline cleaning systems. Rorig et al., U.S. Pat. Nos. 4,842,771 and 4,853,146, teach compositions containing quaternary ammonium and tertiary amine oxide surfactants, organic anionic sulfonates and water. The combination of ingredients forms a thickened relatively thixotropic single phase cleaning material. Smith, U.S. Pat. Nos. 5,011,538 and 5,055,219, teach viscoelastic thickening compositions and methods of use containing quaternary ammonium compounds, organic counterions that can act as a hard surface cleaner. Stoddart et al., U.S. Pat. No. 4,783,283, teaches aqueous cleaning compositions displaying shear thinning behavior comprising alkyl amine oxides in combination with alkyl benzene sulfonate. Such compositions can contain alkali metal hypochlorite bleaches for hard surface cleaning. Messenger et al., U.S. Pat. No. 4,753,754, teaches lamellar phase liquid crystalline materials which are pourable at ambient temperatures. Such compositions contain a variety of anionic surfactants combined with a variety of other conventional cleaning materials.

Klewsaar, U.S. Pat. No. 4,888,119 discloses anionic/cationic surfactant complexes and their use in microemulsions for wash cycle fabric softening and Kern, U.S. Pat. No. 4,786,422 and Thomas, U.S. Pat. No. 4,929,367 describe such complexes, but in particulate wash cycle fabric softening additives. However, none of these patent applications describes or suggests applicants' preferred thickened systems or the diluted thick composition and none describes or suggests the unexpectedly beneficial removals of fatty soils resulting when such compositions are used, especially in dilute form. Carlton et al., European Patent Application No. 137,871, teaches a single phase viscous amine oxide anionic surfactant system containing an ionizable material providing an ionic strength to the cleaner of at least 3.5 moles/$cm^3$.

British patent specification No. 2,190,681 and Loth, U.S. Pat. Nos. 5,076,954 and 5,108,643 disclose microemulsion cleaning compositions in concentrated and dilute forms, which comprise anionic synthetic organic surfactant, hydrocarbon solvent, cosurfactant and water, and which are intended for removing greasy soil from hard surfaces. Neil et al., European Patent Application No. 314,232, teaches and exemplifies thickened aqueous cleaners using a variety of surfactant cleaner materials with lower alcoholic (ethanol, isopropanol, etc.) solvents for hard surface cleaning. Non-thickened enzyme based cleaners are disclosed in Anderson et al., U.S. Pat. No. 4,421,664; Guilbert, U.S. Pat. No. 4,238,345, and others. Acid base cleaners are shown in Pikaar, U.S. Pat. No. 3,211,659; Casey, U.S. Pat. No. 4,587,030; Aszman et al., U.S. Pat. No. 4,501,680; and Norman et al., United Kingdom Patent Application No. 2,012,837. However, such prior art do not disclose the presence in such compositions of applicants, thickened systems or other complexes of anionic and cationic surfactants, glycol ether solvents and do not disclose the unexpectedly beneficial removal of fatty soils from both hard surfaces items and from laundry by microemulsions containing such complexes.

In the research and development of the thickened aqueous cleaners of the invention, we have noted a substantial failure of the prior art to produce an effective cleaning composition that combines low temperature cleaning efficacy with sufficient viscosity to maintain a substantial concentration of cleaning composition on partial or substantially vertical surfaces without draining substantial quantities of the ingredients from the soil. Further, a concentrate cleaning material that can thicken upon dilution and can contain cooperating ingredients that can penetrate, soften and promote removal of difficult soil has not been fully developed. A substantial need exists for thickened aqueous cleaners for the household, institutional and industrial food preparation environment.

BRIEF DISCUSSION OF THE INVENTION

We have found aqueous compositions, containing a rod micellar thickening system, an active cleaning system, comprising an alkaline cleaner, an acidic cleaner or an enzyme composition, an effective amount of a sequestrant and an alkyl glycol ether solvent material, can remove hard soils from vertical or inclined surfaces. The dilute use solutions are shear thinning (thixotropic) to permit ease of application of the material to soiled surface from dispensing devices. The compositions can be made in the form of an aqueous concentrate suitable for dilution to 1–40 vol %, preferably 2–25 vol %, which upon dilution increases in viscosity substantially and results in an effective cleaner.

The rod micellar thickening composition provides thickening of the concentrates. The concentrate materials upon dilution can thicken further to aid in soil adherence, softening and removal. The active cleaning system and the alkyl glycol ether solvent cooperate to achieve rapid and substantially complete soil removal. We have surprisingly found that the alkyl glycol ether solvents can be combined with the rod micellar thickener to form single phase compatible cleaning systems with no reduction in viscoelastic properties and with no lessening of cleaning efficiency. The components of the rod micellar thickening system in combination with a solvent and active cleaning system cooperate to penetrate, soften and promote removal of soils to a degree that is surprising in view of past results.

DETAILED DESCRIPTION OF THE INVENTION

The thickened aqueous compositions of the invention comprise an aqueous medium containing a rod micellar thickening system, a surfactant composition, an alkyl glycol ether solvent composition, and an active cleaning system. The active cleaning system can comprise an alkaline cleaner, an acid cleaner or an enzyme composition. With certain solids and in hard water areas, the cleaners of the invention can contain an effective sequestering amount of a hardness ion sequestering agent. The materials of the invention are low viscosity concentrated detergents containing solvent and surfactant which is dilutable to a high viscosity use solution.

The rod micellar system acts as a thickening agent and uses as a primary composition a nitrogen containing cationic surfactant used in the presence of an anionic material.

The thickened liquid cleaner compositions of the invention can be formed in a variety of formulations and can provide cleaning and stain removal, hardness, sequestration and other cleaning properties. The liquid cleaners of the invention are thickened to increase contact time on surfaces that promote liquid product drainage. Such surfaces are ceiling or other horizontal surfaces, having soils as a bottom facing surface, inclined, vertical or substantially vertical surfaces. In particular the composition of the invention are formulated to clean surfaces having stubborn soils particularly common in food preparation units such as ovens, ranges, microwave ovens, broilers, barbecue grills and other similar units. Such soils are common on surfaces that contact proteinaceous or fatty foods at high temperature resulting in the formation of a hard, baked-on, often browned or blackened, hard to remove soil layer.

The materials in the prior art typically fail for two reasons, either the formulation viscosity is not sufficient to maintain the materials in contact with the food soils for a sufficient period of time or if viscous enough to remain for a sufficient contact time, it does not provide soil softening and soil removing properties.

The longer adherence times of the compositions of the present invention results in improved removal of soil, hardness components and microorganisms because the viscosity of the material maintains a high and effective concentration of the cooperating cleaning materials comprising a source of alkalinity, a sequestrant and a solvent material that cooperate to achieve surprising cleaning results.

Rod Micellar Systems

The thickening systems used in the invention use nitrogen containing amine, quaternary ammonium or amine oxide cationic materials and an anionic counterion to form a rod micellar thickener composition. Typically, the rod micellar compositions are made from cationic surfactant materials that are not fully soluble in aqueous media. The partial solubility promotes formation of a micellar structure with the hydrophobic portion of the cationic material in the interior of the micelle structure and the hydrophilic portion on the micelle exterior. Common useful cationics include trialkylamines, amines having one or two alkyl groups and correspondingly two or one alkylene oxide groups, preferably ethylene oxide groups; commonly available quaternary ammonium compounds can be used wherein the quaternary ammonium compound is made from aliphatic amines, aromatic amines or alkyl substituted aromatic amine substituents and trialkylamine oxides.

Rod micellar formation occurs at a specific concentration of cationic surfactant. Below the critical concentration commonly no micelle or a spherical micelle forms wherein the interior of the sphere micelle comprises the alkyl or hydrophobic portion of the cationic surfactant and the hydrophilic portion is on the exterior of the micelle. At a specific point in the concentration of the cationic surfactant, the sphere incorporates additional amounts of the cationic surfactant, lengthens and becomes rod shaped. The viscosity of the aqueous material containing the micelle substantially increases with the length of the rod micelle formation. As the micelles lengthen at a certain point the micelle can entangle in other micelle lengths to form entanglements having a three dimensional network which contributes to substantial viscosity increase. Anionic counterions, in particular aromatic anionic counterions work effectively to stabilize the micellar surface resulting in the tendency that even the more soluble cationic surfactants can form stable rod micelles in the presence of stabilizing aromatic counterions. Similarly, additional cationic and anionic surfactants can aid in stabilizing micelle formation. In aqueous solution, a variety of the nitrogen base amine, quat or amine oxide compositions or mixtures thereof can be used to make the rod micelles. However, in alkaline cleaners the amine oxide and certain quaternary ammonium compounds and certain mixtures thereof are preferred due to their outstanding stability against oxidation and stability in aqueous alkaline materials.

Cationic rod micellar thickening system is shear thinning and has the capacity to build viscosity upon dilution with water. Concentrate materials formed using the thickening compositions of the invention when diluted to between 2 and 25 wt % by water can increase in viscosity by a factor of between 2 and 10. Initial viscosities of the thickened materials are often low compared to diluted use solution and can range from 2–15 cP Brookfield LVT viscometer with a number C-1 spindle at 60 rpm and 21° C. but the diluted materials, preferably 2 vol % or 25 vol % dilutions, can have a viscosity that can be greater than 10 and can often be between 50 and 200 cP under appropriate measuring conditions.

The anionic surfactants, counterions and the cationic surfactants which interact to form the rod micelle thickeners utilized in the invented compositions may be any such suitable reactant materials, although it is highly preferred to employ such surfactants which include one or more hydrophilic components other than the complex forming components thereof, so that the solubility in water of the complex resulting will be in the range of 5 to 70%, preferably 10 to 60%, more preferably 20 to 50%, e.g. about 35%.

The cationic surfactants useful to make the present complexes may be any suitable such compounds which form the desired rod micelle including the preferred quaternary ammonium compounds, amines and amine oxides. Preferable among such cationic surfactants are quaternary ammonium salts, in which at least one higher molecular weight group and two or three lower molecular weight groups are linked to a common nitrogen atom to produce a cation, and wherein the electrically balancing anion is a halide, acetate, nitrite or lower alkosulfate, such as bromide, chloride or methosulfate. For convenience, the aliphatic quaternary ammonium salts may be structurally defined as follows:

$$(R\ R_1\ R_2\ R_3)N^-X^-$$

wherein R and $R_1$ represent alkyl of 12 to 24 and preferably 14 to 22 carbon atoms; $R_2$ and $R_3$ represent lower alkyl of 1 to 4 and preferably 1 to 3 carbon atoms, and X represents an anion capable of imparting water solubility or dispersibility including the aforementioned chloride, bromide, iodide, sulfate and methosulfate. The higher molecular weight substituent on the nitrogen if often a higher alkyl group, containing 10 or 12 to 18 or 20 carbon atoms and the lower molecular weight substituents may be lower alkyl of 1 to 4 carbon atoms, such as methyl and ethyl, which often are desirably substituted, as with hydroxy groups. One or more of said substituents may include an aryl moiety or may be replaced by an aryl such as benzyl or phenyl. Among the possible lower molecular weight substituents are also lower alkyls of 1 to 4 carbon atoms, such as methyl and ethyl, which are substituted by poly-lower alkoxy moieties, such as polyethoxy moieties bearing a hydroxyl end group, and being of the general formula $R(X)_nOH$ wherein R is $C_{1-4}$ alkyl bonded to the nitrogen, X is $CH_2CH_2O$, $CH(CH_3)CH_2O$ or $CH_2CH_2CH_2O$, and n is from 1 to 20. Alternatively, one or two of such lower poly-lower alkoxy moieties, having terminal hydroxyls, may be directly bonded to the quaternary nitrogen instead of being bonded to it through the lower alkyl.

Typical examples of quaternary ammonium compounds useful in the rod micelle system are: distearyl dimethylammonium chloride, dihydrogenated tallow dimethyl ammonium chloride, ditallow dimethyl ammonium chloride, distearyl dimethyl ammonium methyl sulfate, and di-hydrogenated tallow dimethyl ammonium methyl sulfate, ethyl-dimethyl-stearyl ammonium chloride, ethyl-dimethyl-stearyl ammonium bromide, cocoalkyl-trimethyl ammonium chloride, hydrogenated tallow-trimethyl ammonium chloride, hydrogenated tallow-trimethyl ammonium bromide, stearyl-trimethyl ammonium chloride, stearyl-trimethyl ammonium bromide, trimethyl-cetyl ammonium bromide, dimethyl-ethyl-lauryl ammonium chloride, tallow trimethyl ammonium chloride, tallow trimethyl ammonium bromide, propyl-myristyl ammonium chloride and the corresponding methosulphates, acetates, and the like. A preferred group of the cationic ammonium compounds include (hydrogenated) tallow-trimethyl ammonium chloride, (hydrogenated) tallow-trimethyl ammonium bromide, tallow trimethyl ammonium bromide, tallow trimethyl ammonium chloride, soya alkyl-trimethyl ammonium chloride, soya alkyl-trimethyl ammonium bromide, cetyl-trimethyl ammonium chloride, and methyl-bis(2-hydroxy ethyl) oleyl ammonium chloride. Most preferably tallow-trimethyl ammonium chloride is used.

Typical examples of tertiary amine oxides include amine oxides having two $C_{1-5}$ alkyl groups and one larger $C_{6-30}$ alkyl group. Representative of such materials are dimethyl-coco amine oxide, dimethyl lauryl amine oxide, dimethyl oleyl amine oxide, coco bis ethoxy amine oxide, tallow bis ethoxy amine oxide, and others bis(2-hydroxy ethyl) cetylamine oxide, bis(2-hydroxy ethyl) tallowamine oxide, bis (2-hydroxy ethyl) hydrogenated tallow amine oxide, bis(2-hydroxy ethyl) stearylamine oxide, bis(2-hydroxy propyl) tallowamine oxide, bis(2-hydroxy propyl) stearyl amine oxide, dimethyl tallowamine oxide, dimethyl cetylamine oxide, dimethyl stearylamine oxide, and di-ethyl stearylamine oxide. A preferred group of the amine oxides include dimethyl cetylamine oxide, and bis(2-hydroxy ethyl) tallowamine oxide and mixtures thereof. Most preferably bis (2-hydroxy ethyl) tallowamine oxide is used.

Useful amines can be selected from primary, secondary or tertiary amines and diamines carrying at least one nitrogen linked hydrocarbon group, which represents a saturated or unsaturated linear or branched alkyl group having at least 10 carbon atoms and preferably 16–24 carbon atoms, or an aryl, aralkyl or alkaryl group containing up to 24 carbon atoms, and wherein the optional other nitrogen linked groups are formed by optionally substituted alkyl groups, aryl group or aralkyl groups or polyalkoxy groups and preferably polyethoxy or polypropoxy groups, containing at most 5 alkoxy groups and more preferably 1–3, or wherein the amine is in the form of a hetercyclic ring, containing at least two nitrogen atoms, one of which being substituted by amino (lower) alkyl or hydroxy (lower) alkyl, preferably reacted with fatty acids, with the ring further carrying a linear or branched alkyl or alkenyl group having at least 10 carbon atoms.

Specific useful classes of the amines as specified under (b) can be represented by the following formulae:

I

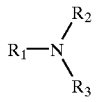

wherein $R_1$ represents a saturated or unsaturated linear or branched alkyl group having at least 10 carbon atoms and preferably 16–24 carbon atoms, or an aryl, aralkyl or alkaryl group containing up to 24 carbon atoms, wherein $R_2$ and $R_3$ may be the same or different and represent hydrogen, an alkyl group, and preferably a lower alkyl group containing 1–4 carbon atoms and more preferably a methyl group, or poly(alkoxy) group, preferably a poly(ethoxy) or poly (propoxy) group, wherein more preferably the number of ethoxy or propoxy radicals is at most 5, or

II

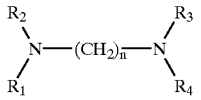

wherein $R_1$ is as defined before and $R_2$, $R_3$ and $R_4$ may be the same or different and represent hydrogen, alkyl, poly (ethoxy) or poly(propoxy) groups, and n is a number from 1 to 6 and more preferably 2–4.

A class of more specific examples of the amines as defined hereinbefore comprises: oleyl amine, stearyl amine, tallow amine, hydrogenated tallow amine, lauryl amine, myristyl amine, cetyl amine, and soya alkyl amine or mixtures thereof. A preferred group of these compounds comprises oleyl amine and tallow amine.

According to another embodiment of the present compositions, a typical class of amines as defined hereinbefore, comprises: bis(2-hydroxyethyl)oleyl amine, bis(2-hydroxyethyl ethoxy)oleyl amine, bis[2-hydroxyethyl tetra(ethoxy)]oleyl amine, bis(2-hydroxyethyl)stearyl amine, bis(2-hydroxyethyl ethoxy)stearyl amine, bis[2-hydroxyethyl tetra(ethoxy)]stearyl amine, bis(2-hydroxyethyl)tallow amine, bis(2-hydroxyethyl) hydrogenated tallow amine, bis[2-hydroxyethyl tetra(ethoxy)] tallow amine, bis(2-hydroxyethyl)lauryl amine, bis(2-hydroxyethyl)myristyl amine, bis(2-hydroxyethyl)soya alkyl amine, bis(2-hydroxyethyl ethoxy) soya alkyl amine, bis[2-hydroxyethyl tri(ethoxy)]soya alkyl amine, bis(2-hydroxypropyl)oleyl amine, bis(2-hydroxypropyl)stearyl amine, bis(2-hydroxypropyl) tallow amine, bis(2-hydroxypropyl) hydrogenated tallow amine, bis(2-hydroxypropyl)lauryl amine, bis(2-hydroxypropyl)myristyl amine, bis(2-hydroxypropyl)cetyl amine, bis(2-hydroxypropyl)soya alkyl amine and mixtures thereof.

A preferred group of these compounds comprises: bis(2-hydroxyethyl) tallow amine, bis(2-hydroxyethyl) hydrogenated tallow amine, bis(2-hydroxyethyl)soya alkyl amine, bis(2-hydroxyethyl)cetyl amine, bis(2-hydroxyethyl)oleyl amine, bis(2-hydroxypropyl) tallow amine, bis(2-hydroxypropyl) hydrogenated tallow amine, bis(2-hydroxypropyl)soya alkyl amine, bis(2-hydroxypropyl)cetyl amine, bis(2-hydroxypropyl)oleyl amine, bis(2-hydroxyethyl ethoxy) tallow amine, bis(2-hydroxyethyl ethoxy) hydrogenated tallow amine, bis(2-hydroxyethyl ethoxy)soya alkyl amine, bis(2-hydroxyethyl ethoxy)cetyl amine, bis(2-hydroxyethyl ethoxy)oleyl amine, bis(2-hydroxypropyl propoxy) tallow amine, bis(2-hydroxypropyl propoxy) hydrogenated tallow amine, bis(2-hydroxypropyl propoxy)soya alkyl amine, bis(2-hydroxypropyl propoxy) cetyl amine, and bis(2-hydroxypropyl propoxy)oleyl amine, bis(2-hydroxyethyl)oleyl amine, bis(2-hydroxypropyl)oleyl amine, bis(2-hydroxypropyl) tallow amine and bis(2-hydroxyethyl) tallow amine can be used.

According to another embodiment of the present compositions, a typical specific class of amines as defined hereinbefore, comprises: N,N-dimethyl oleyl amine, N,N-dibenzyl oleyl amine, N,N-dipropyl oleyl amine, N,N-dimethyl stearyl amine, N,N-diethyl stearyl amine, N,N-dibenzyl stearyl amine, N,N-dimethyl (hydrogenated) tallow amine, N,N-diethyl (hydrogenated) tallow amine, N,N-dipropyl (hydrogenated) tallow amine, N,N-dibenzyl (hydrogenated) tallow amine, N,N-difenyl (hydroganted) tallow amine, N,N-diethyl lauryl amine, N,N-diethyl myristyl amine, N,N-dipropyl myristyl amine, N,N-dibenzyl cetyl amine, and N,N-dimethyl cetyl amine or mixtures thereof.

A preferred group of the latter class comprises: N,N-dimethyl oleyl amine, N,N-dimethyl lauryl amine, N,N-dimethyl cetyl amine, N,N-dimethyl myristyl amine, N,N-dimethyl soya alkyl amine, N,N-dimethyl tallow amine, and N,N-dimethyl stearyl amine or mixtures thereof.

Most preferably N,N-dimethyl oleyl amine, N,N-dimethyl tallow amine, and N,N-dimethyl soya alkyl amine are used.

According to another embodiment of the present compositions, a typical specific class of amines as defined hereinbefore, comprises: N-oleyl-1,3-diaminopropane, N-stearyl-1,3-diaminopropane, N-(hydrogenated) tallow-1,3-diaminopropane, N-soya alkyl-1,3-diamonopropane, N-lauryl-1,3-diaminopropane, N-myristyl-1,3-diaminopropane, N-cetyl-1,3-diaminopropane, N-oleyl-1,4-diaminobutane, N-stearyl-1,4-diaminobutane, N-(hydrogenated) tallow-1,4-diaminobutane, N-soya alkyl-1,4-diaminobutane, N-lauryl-1,4-diaminobutane, N-myristyl-1,4-diaminobutane, and N-cetyl-1,4-diaminobutane, and mixtures thereof.

The amine, amine oxide or quaternary ammonium compound may preferably be used in amounts from 0.01 to 30% by weight based on the total weight of the composition dependent on the viscosity and the type of the agent desired.

The anionic materials used in the invention will preferably be low molecular weight coupling agents or detergents and will normally include a lipophilic moiety that can be a $C_{15}$ alkyl or a long chain alkyl or alkenyl group of at least 5–12 carbon atoms, such as 10–12 to 18–20 carbon alkyl. Such anionic detergent will also usually include a sulfonic, sulfuric or carboxylic acidic group, which, when neutralized, will be a sulfonate, sulfate or carboxylate, with the cation thereof preferably being alkali metal, ammonium or alkanolamine, such as sodium, ammonium or triethanolamine. Although the higher alkyls of such detergents may be of 10 to 20 carbon atoms, normally they will be of 12 to 18 carbon atoms, preferably 12 to 16 carbon atoms and more preferably 12 to 14 carbon atoms (which may be designated in this specification as $C_{12-14}$ alkyls). A variety of anionic materials including salicylitic, cumene sulfonate 2-hydroxy benzoate para-toluene surfactants can be used. Preferred anionics are aromatic in character.

Examples of operative anionic sulfonate or sulfate surfactants include sodium xylene sulfonate; sodium dodecylbenzene sulfonate; sodium linear tridecylbenzene sulfonate; potassium octadeceylbenzene sulfonate; sodium lauryl sulfate; triethanolamine lauryl sulfate; sodium palmityl sulfate; sodium cocoalkyl sulfate; sodium tallowalkyl sulfate; sodium ethoxylated higher fatty alcohol sulfate, which will usually be of 1 to 20 ethylene oxide groups per mole, such as sodium lauryl monoethoxy ether sulfate, sodium lauryl diethoxy ether sulfate and sodium $C_{12-14}$ alkyl diethoxy ether sulfate; sodium $C_{14-17}$ paraffin sulfonate; sodium olefin sulfonate (of 10 to 20 carbon atoms in the olefin); sodium cocomonoglyceride sulfate; and sodium cocotallow soap (1:4 coco:tallow ratio). The preferred anionic is a small molecular aromatic counterion coupling agent that acts to maintain the concentrate components in a uniform aqueous composition. Such materials stabilize the rod micelle by strongly binding to the micelle surface forcing the soluble cationic surfactant to form rod micelles. The most preferred anionic is a sodium xylene sulfonate.

In addition to the cationic compounds previously mentioned, other suitable cationic surfactants include the imidazolinium salts, such as 2-heptadecyl-1-methyl-1-[(2-stearoylamido) ethyl]-imidazolinium chloride; the corresponding methyl sulfate compound; 2-methyl-1-(2-hydroxyethyl)-1-benzyl imidazolinium chloride; 2-coco-1-(2-hydroxyethyl)-1-octadecenyl imidazolinium chloride; 2-heptadecenyl-1-(2-hydroxyethyl)-1-(4-chlorobutyl) imidazolinium chloride; and 2-heptadecyl-1-(hydroxyethyl)-1-octadecyl imidazolinium ethyl sulfate. Generally, the imidazolinium salts of preference will be halides (preferably chlorides) and lower alkyl-sulfates (alkosulfates), and will include hydroxy-lower alkyl substituents.

A preferred embodiment of the present invention is formed by thickened compositions containing one or more salts of the anionic counterion stabilizer for the rod micelle system. Typical salts of the sulphonates specified under (b) are the sodium, potassium, ammonium, lower amine and alkanolamine salts, of which the sodium salts are preferred.

Solvent

The glycol ether solvents useful in combining with the rod micellar alkaline cleaning composition and the sequestrants of the invention to produce soil removal are lower alkyl glycol ethers which are colorless liquids with mild pleasant odors. Materials are excellent solvents and coupling agents and are typically miscible with aqueous cleaning compositions of the invention. The boiling points of the materials fall within a range of about 100 to about 250° C. The glycol solvents are based on ethylene glycol, diethylene glycol, triethylene glycol, propylene glycol, dipropylene glycol, tripropylene glycol or mixed ethylene propylene glycol ethers. The preferred glycol ethers are lower alkyl ethers; the term lower alkyl indicates a $C_{1-8}$ alkyl group including methyl, ethyl, propyl, isopropyl, n-butyl, isobutyl, tertiary butyl and n-amyl, isoamyl, tertiary amyl, etc. Such solvents can include propylene glycol methyl ether, dipropylene glycol methyl ether, dipropylene glycol ethyl ether, tripropylene glycol methyl ether, propylene glycol isobutyl ether, ethylene glycol methyl ether, ethylene glycol ethyl ether, ethylene glycol diethyl ether, ethylene glycol dibutyl ether, diethylene glycol methyl ether, diethylene glycol dimethyl ether, diethylene glycol ethyl ether, diethylene glycol diethyl ether, diethylene glycol butyl ether, ethylene glycol dimethyl ether and other similar materials. The preferred solvent is a monomethyl glycol ether solvent including propylene glycol methyl ether, diethylene glycol methyl ether, dipropylene glycol methyl ether, tripropylene glycol methyl ether and mixtures thereof for reasons relating to the cooperation with alkalinity and sequestering agents in softening and removing soil in particularly hard baked-on soils. Further, we find that these solvents are surprisingly compatible with rod micelle formation and do not prevent effective viscosity increase upon dilution.

Sequestrant

The thickened materials of the invention can contain an organic or inorganic sequestrant or mixtures of sequestrants. Organic sequestrants such as citric acid, the alkali metal salts of nitrilotriacetic acid (NTA), EDTA, alkali metal gluconates, polyelectrolytes such as a polyacrylic acid, and the like can be used herein. The most preferred sequestrants are organic sequestrants such as sodium gluconate due to the compatibility of the sequestrant with the formulation base.

The present thickened cleaning materials will also comprise an effective amount of a water-soluble organic phosphonic acid which has sequestering properties. Preferred phosphonic acids include low molecular weight compounds containing at least two anion-forming groups, at least one of which is a phosphonic acid group. Such useful phosphonic acids include mono-, di-, tri- and tetra-phosphonic acids which can also contain groups capable of forming anions under alkaline conditions such as carboxy, hydroxy, thio and the like. Among these are phosphonic acids having the formulae:

$$R_1N[CH_2PO_3H_2]_2 \text{ or } R_2C(PO_3H_2)_2OH$$

wherein $R_1$ may be -[(lower)alkylene]$N[CH_2PO_3H_2]_2$ or a third $CH_2PO_3H_2$ moiety; and wherein $R_2$ is selected from the group consisting of $C_1$–$C_6$ alkyl.

The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid.

Other organic phosphonic acids include 1-hydroxyethylidene-1,1-diphosphonic acid ($CH_3C(PO_3H_2)_2OH$), available from Monsanto Industrial Chemicals Co., St. Louis, Mo. as Dequest® 2010, a 58–62% aqueous solution; amino [tri(methylenephosphonic acid)] ($N[CH_2PO_3H_2]_3$), available from Monsanto as Dequest® 2000, a 50% aqueous solution; ethylenediamine [tetra (methylene-phosphonic acid)] available from Monsanto as Dequest® 2041, a 90% solid acid product; and 2-phosphonobutane-1,2,4-tricarboxylic acid available from Mobay Chemical Corporation, Inorganic Chemicals Division, Pittsburgh, Pa. as Bayhibit AM, a 45–50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used. Further useful phosphonic acids are disclosed in U.S. Pat. No. 4,051,058, the disclosure of which is incorporated by reference herein. Of the phosphonic acids useful in the present invention, those which do not contain amino groups are especially preferred, since they produce substantially less degradation of the active chlorine source than do phosphonic acids comprising amino groups.

The present compositions can also incorporate a water soluble acrylic polymer which can act to condition the wash solutions under end-use conditions. Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water-soluble salts or partial salts of these polymers such as the respective alkali metal (e.g. sodium potassium) or ammonium salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 6,000. These polymers are commercially available, and methods for their preparation are well-known in the art.

For example, commercially-available water-conditioning polyacrylate solutions useful in the present cleaning solutions include the sodium polyacrylate solution, Colloid® 207 (Colloids, Inc., Newark, N.J.); the polyacrylic acid solution, Aquatreat® AR-602-A (Alco Chemical Corp., Chattanooga, Tenn.); the polyacrylic acid solutions (50–65% solids) and the sodium polyacrylate powders (m.w. 2,100 and 6,000) and solutions (45% solids) available as the Goodrite® K-700 series from B.F. Goodrich Co.; and the sodium- or partial sodium salts of polyacrylic acid solutions (m.w. 1000–4500) available as the Acrysol® series from Rohm and Haas.

Such sequestrants include materials such as, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are the preferred sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Sodium tripolyphosphate is a preferred inorganic hardness sequestering agent for reasons of its ease of availability, low cost, and high cleaning power. Sodium tripolyphosphate acts to sequester calcium and/or magnesium cations, providing water softening properties. It contributes to the removal of soil from hard surfaces and keeps soil in suspension. It has little corrosive action on common surface materials and is low in cost compared to other water conditioners. Sodium tripolyphosphate has relatively low solubility in water (about 14 wt-%) and its concentration must be increased using means other than solubility. Typical examples of such phosphates being alkaline condensed phosphates (i.e. polyphosphates) such as sodium or potassium pyrophosphate, sodium or potassium tripolyphosphate, sodium or potassium hexametaphosphate, etc.; carbonates such as sodium or potassium carbonate; borates, such as sodium borate; etc.

Cleaning Systems

The aqueous cleaner of the invention can contain a cleaning system selected from the group of a source of alkalinity, an acid cleaning system and an enzyme cleaning composition.

Source of Alkalinity

The liquid aqueous cleaners of the invention can contain a source of alkalinity which can be an organic source or an inorganic source of alkalinity. Organic sources of alkalinity are often strong nitrogen bases including, for example, ammonia, monoethanol amine, monopropanolamine, diethanolamine, dipropanolamine, triethanolamine, tripropanolamine, etc.

The inorganic alkali content of the alkaline cleaners of this invention is preferably derived from sodium or potassium hydroxide which can be used in both liquid (about 10 to 60 wt-% aqueous solution) or in solid (powdered, flake or pellet) form. The preferred form is commercially-available sodium hydroxide, which can be obtained in aqueous solution at concentrations of about 50 wt-% and in a variety of solid forms of varying particle size and shape.

For some cleaning applications, it is desirable to replace a part or all of the alkali metal hydroxide with an alkali metal silicate such as anhydrous sodium metasilicate. When incorporated into the thickened cleaners within the preferred temperature ranges, at a concentration of about 1–20% by weight of the emulsion, anhydrous sodium metasilicate can protect metal surfaces against corrosion.

Acid Cleaning System

The aqueous cleaning compositions of the invention can contain as a cleaning system an acid composition that can be a weak or strong acid. For the purposes of this invention, an acid material is a composition that can be added to an aqueous system and result in a pH less than 7. Strong acids that can be used in the aqueous cleaners of the invention are acids which substantially dissociate an aqueous solution such as hydrochloric acid, sulfuric acid, trichloroacetic acid, trifluoroacetic acid and others. "Weak" organic and inorganic acids used in the invention are acidic components in which the first dissociation step of a proton from the acid moiety does not proceed essentially to completion when the acid is dissolved in water at ambient temperatures at a concentration within the range useful to form the present compositions. Such inorganic acids are also referred to as weak electrolytes as the term is used in Text Book of Quantitative Inorganic Analysis, I. M. Koltoff et al. as the McMillan Co., Third Edition, 1952 at pp. 34–37. Most common commercially available weak organic and inorganic acids can be used in the invention. Examples of weak inorganic acids include phosphoric acid and sulfamic acid. Useful weak organic acids include acetic acid, hydroxyacetic acid, citric acid, benzoic acid, tartaric acid, and the like. We have found in certain applications that mixtures of a strong acid with a weak acid or mixtures of a weak organic acid and a weak inorganic acid can result in surprisingly increased cleaning efficiency. Such acid cleaners tend to be most effective to clean basic organic and inorganic soils. The most commonly cleaned soil using acid cleaners involves the precipitation of hardness components of service water with cleaning compositions or food soils that can precipitate in the presence of calcium, magnesium, iron, manganese or other hardness components. Such soils include dairy residues, soap scum, saponified fatty acids, or other marginally soluble anionic organic species that can form a soil precipitate when contacted with divalent hardness components of surface water.

Enzyme Cleaning Compositions

We have found that enzyme activity of a variety of enzymes that can aid in the softening and removal of proteinaceous, lipid and carbohydrate soils can be maintained in the presence of the solvent rod micellar system and other components of the thickened aqueous cleaners of the invention. Enzymes are used for many purposes in various fields where biochemical reactions occur. In general, an enzyme can be described as a catalyst capable of permitting a biochemical reaction to quickly occur and can be classified according to the type of reaction they catalyze. Enzymes have complex polypeptide structures and often have co-enzymes, metal components and a variety of other co-reactive systems. Enzymes are characterized by a high specificity, each enzyme can catalyze a single reaction of one substance or a very small number of close related substances. Examples of enzymes suitable for use in the cleaning compositions of the invention include lipases (fat cleaning enzymes), peptidases (protein cleaning enzymes), amylases (amylolytic enzymes) and others which degrade, alter or facilitate the degradation or alterations of biochemical soils and stains encountered in cleaning situations. The enzymes either remove more easily the soil or stain from hard surface fabric or other object being cleaned or make the soil or stain more removable in subsequent steps. Both degradation and alteration can improve soil removability well known in preserved examples of these enzymes or protein hydrolases, lipases and amylases.

Lipases are classified as EC class 3 hydrolases, subclass EC 3.1, preferably carboxylic ester hydrolases EC 3.1.1. An example thereof are lipases EC 3.1.1.3 with the schematic name glycerol ester hydrolases.

Amylases belong to the same general class as lipases, subclass EC 3.2, especially EC 3.2.1 glycolytic hydrolases such as 3.2.1.1 alpha-amylase with a systematic name alpha 1,4 glucan-4-glucano hydrolase; and also 3.2.1.2, beta amylase with the schematic name alpha-1,4-glucan multihydrolase.

Proteases belong to the same class as lipases and amylases, subclass 3.4 particularly EC 3.4.4 peptide peptido-hydrolases such as EC 3.4.4.16 with a schematic name subtilopeptidase A. The foregoing classes should not be used to limit the scope of the invention. Enzymes serving different functions can also be used in the practice of the invention. The selection of the enzyme depending on the composition of biochemical soil, intended purpose of a particular composition and the availability of an enzyme to degrade or alter the soil. Lipases, some times called esterases, hydrolyze fatty soils. The main factors influencing the specificity of the lipase enzyme are the length and shapes of the substantially hydrocarbon group on either side of the fatty acid ester link. Suitable lipases for use herein include enzymes of animal, plant or microbiological origin.

The amylolytic enzymes which can be stabilized and enhanced in the cleaning composition embodiment can be of fungal, plant, animal or bacterial origin and can be made using recombinant DNA manufacturing techniques. Suitable amylolytic enzymes including alpha- and beta-amylases. By way of example, suitable alpha-amylases of mold origin including those derived from *Aspergillus oryzae Aspergillus niger, Aspergillus alliaceus, Aspergillus wentii,* and *Pencillium glaucum.* The alpha-amylases derived from cereal grains, pancreatic sources and such bacteria as *Bacillus subtilis, Bacillus macerans, Bacillus mesentericus* and *Bacillus thermophilus* are also useful herein. These enzymes are active in the pH range of from about 4.5 to about 12 and, depending upon the species, at temperatures including laundering temperatures, i.e. up to about 200° F.

Preferred amylolytic enzymes herein are the alpha-amylases derived from the bacterial organism bacillus subtilis. These amylases provide excellent desizing and starch digestive properties and are especially useful in the laundering of textile materials containing soils and stains of a starchy nature.

The amylolytic enzymes useful herein can be employed in a pure state. Generally, they are employed in the form of a powdered commercially available preparation wherein the amylolytic enzyme is present in an amount of from about 2 to about 80% of the preparation. The remaining portion, i.e. about 20% to about 98%, comprises inert vehicle such as sodium sulfate, calcium sulfate, sodium chloride, clay or the like. The active enzyme content of these commercial enzyme compositions is the result of manufacturing methods employed and is not critical herein so long as the finished compositions of this invention have the hereinafter specified enzyme content. Specific examples of commercial enzyme preparations suitable for use herein and the manufacturers thereof including: Diasmen alpha-amylase (Daiwa Kasei KK, Tokyo, Japan); Rapidase alpha-amylase (Novo Industri, Copenhagen, Denmark), Wallerstein alpha-amylase (Wallerstein Company, Staten Island, N.Y.); Rhozyme-33 and Rhozyme H-39 (Rohm & Haas Philadelphia, Pa.).

The amylolytic enzymes can be employed in the cleaning composition embodiment of this invention in an amount from about 0.005% to about 12%, preferably from 0.01% to 5% of the composition on a pure enzyme basis.

Suitable proteolytic enzymes for use in the detergent composition embodiment can be of vegetable, animal bacterial, mold and fungal origin, and can also be derived from recombinant DNA manufacturing techniques.

The proteolytic enzyme can be employed in the compositions of the present invention in an amount of 0.005% to about 3%, on a pure enzyme basis. Best results in terms of overall cleaning efficacy and stain-removing properties are attained when the proteolytic enzyme is employed in an amount of about 0.01% to about 1% on a pure enzyme basis.

Specific examples of proteases suitable for use are trypsin, colliagenase, keratinase, elastase, subtilisin, BPN and BPN'. Preferred proteases are serine proteases produced from microorganisms such as bacteria, fungi or mold. The serine proteases which are procured by mammalian systems, e.g. pancretin, are also useful herein.

Specific examples of commercial products and the manufacturer thereof include: Alcalase or Esperase, Novo Industri, Copenhagen, Denmark,; Maxatase, Koninklijke, Nederlandsche Gist-En Spiritusfabriek N. V., Delft, Netherlands; Protease B-4000 and Protease Ap, Schweizerische Ferment A. G., Basel, Switzerland; CRD-Protease, Monsanto Company, St. Louis, Mo.; Viokase, BioBin Corporation, Monticello, Ill.; Pronase-P, Pronase-E, Pronase-AS and Pronase-AF all of which are manufactured by Kaken Chemical Company, Japan; Rapidase P-2000, Rapidase Seclin, France; Takamine, HT proteolytic enzyme 200, Enzyme L-W (derived from fungi rather than bacteria), Miles Chemical Company, Elkhart, Ind.; Thozyme P-11 concentrate, Rhozyme PF, Rhozyme J-25, Rohm & Haas, Philadelphia, Pa. (Rhozyme PF and J-25 have salt and corn starch vehicles and are proteases having diastase activity); Amprozyme 200, Jacques Wolf & Company, a subsidiary of Nopco Chemical Company, Newark, N.J.; Takeda Fungal Alkaline Protease, Takeda Chemical Industries, Ltd., Osaka, Japan; Wallterstein 201-HA, Wallerstein Company, Staten Island, N.Y.; Protin As-20, Dawai Kasel K. K., Osaka, Japan; and Protease TP (derived from thermophilic Streptomyces species strain 1689), Central REsearch Institute of Kikkoman Shoya, Noda Chiba, Japan.

Cleaning Surfactants

The detergents can be formulated to contain effective amounts of synthetic organic surfactants and/or wetting agents that are used as cleaning agents that are separate from the rod micellar components. The surfactants and softeners must be selected so as to be stable and compatible with other components including the rod micelle system in the presence of cleaner systems and solvents. Amphoteric surfactants, surfactants containing both an acidic and a basic hydrophilic group can be used in the invention. Amphoteric surfactants can contain the anionic or cationic group common in anionic or cationic surfactants and additionally can contain ether hydroxyl or other hydrophilic groups that enhance surfactant properties. Such amphoteric surfactants include betain surfactants, sulfobetain surfactants, amphoteric imidazolinium derivatives and others. One class of preferred surfactants is the anionic synthetic detergents. this class of synthetic detergents can be broadly described as the water-soluble salts, particularly the alkali metal (sodium, potassium, etc.) salts, or organic sulfuric reaction products having in the molecular structure an alkyl radical containing from about eight to about 22 carbon atoms and a radical selected from the group consisting of sulfonic acid and sulfuric acid ester radicals.

Preferred anionic organic surfactants include alkali metal (sodium, potassium, lithium) alkyl benzene sulfonates, alkali metal alkyl sulfates, and mixtures thereof, wherein the alkyl group is of straight or branched chain configuration and contains about nine to about 18 carbon atoms. Specific compounds preferred from the standpoints of superior performance characteristics and ready availability include the following: sodium decyl benzene sulfonate, sodium dodecylbenzenesulfonate, sodium tridecylbenzenesulfonate, sodium tetradecylbenzene-sulfonate, sodium hexadecylbenzenesulfonate, sodium octadecyl sulfate, sodium hexadecyl sulfate and sodium tetradecyl sulfate.

Nonionic synthetic surfactants may also be employed, either alone or in combination with anionic types. This class of synthetic detergents may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water soluble or dispersible compound having the desired degree of balance between hydrophilic and hydrophobic elements.

For example, a well-known class of nonionic synthetic detergents is made available on the market under the trade name of "Pluronic". These compounds are formed by condensing ethylene oxide with a hydrophobic base formed by the condensation of propylene oxide with propylene glycol. The hydrophobic portion of the molecule has a molecular weight of from about 1,500 to 1,800. The addition of polyoxyethylene radicals to this hydrophobic portion tends to increase the water solubility of the molecule as a whole and the liquid character of the products is retained up to the point where the polyoxyethylene content is about 50 percent of the total weight of the condensation product.

Other suitable nonionic synthetic detergents include the polyethylene oxide condensates of alkyl phenols, the products derived from the condensation of ethylene oxide with the reaction product of propylene oxide and ethylene diamine, the condensation product of aliphatic fatty alcohols with ethylene oxide as well as amine oxides and phosphine oxides.

In addition to the recited components of the compositions of the present invention there may also be present adjuvant materials for dishwashing and other detergent compositions, which materials may include foam enhancing agents, such as lauric myristic diethanolamide, foam suppressing agents (when desired), such as higher fatty acids and higher fatty acid soaps, preservatives and antioxidants, such as formalin and 2,6-ditert. butyl-p-cresol, pH adjusting agents, such as sulfuric acid and sodium hydroxide, perfumes, colorants, (dyes and pigments) and opacifying or pearlescing agents, if desired. Although sometimes small proportions of builder salts may be added to the present compositions for their building functions, normally such will be omitted because they tend to produce cloudy emulsions and can interfere with desired soil solubilizing properties of the thickened cleaner. In addition to the mentioned adjuvants, sometimes it may be desirable to include water soluble metal salts, such as chlorides and sulfates of magnesium and aluminum, to react with the anionic detergent to convert it to such a metal salt, which may improve performance of the diluted compositions. However, such salts are not required components of such composition and normally work best at acidic or neutral pH's, if employed. The bivalent or multi-valent metal salts will normally not be present in any substantial excesses over their stoichiometric proportions with respect to the anionic detergent(s).

To make the rod micelle compositions of the invention, a variety of blending techniques can be employed. Typically the materials are blended in service or deionized water. Commonly, the anionic or counterion surfactant like materials used in rod micellar formation are added first followed by the hydrophilic cationic surfactant rod micellar composition and then by soluble organic or inorganic cleaning compositions. The solvents are added prior to the addition of the micellar components to form the thickened aqueous cleaning materials. The rod micellar materials are commonly single phase, clear or opaque, aqueous stable compositions and are capable of being diluted with water to useful highly thickened cleaning compositions at a proportion of the gel to water of about 1 to about 25 parts of the gel per 100 parts of total cleaning composition. The present rod micellar thickened compositions can be successfully employed without dilution to remove extremely heavy deposits of greasy fats and oils and baked-on deposits on dishes, pans and other hard surfaces. Before normal hand washing or dishwashing the materials can be employed to dissolve soils and prespotting treatments of the hard surfaces or even in laundry items that have been stained with greasy soils. In dilute form the rod micellar materials of the invention can be diluted by combining from about 1 to about 15 parts of the rod micellar gel with water to form a 1–15 wt % solution of the material in water. Preferred dilutions are at 2 vol % or 25 vol %.

For various cleaning applications, the temperature of the material can range from about 15–90° C., preferably about 20–70° C. The diluted use solution can be applied as a liquid using a variety of well known liquid application devices. Further, the material can be foamed using a hand pumped sprayer aspirator, or other dispensing unit or pressurized tank applicator. Advantages of the invention have been referred to previously and have been described in some detail, however, the present rod micellar thickened materials of the invention contain a combination of ingredients that provide surprisingly successful cleaning operations when contacted with soil on vertical, substantially vertical or inclined surfaces to maintain a sufficient concentration of the material in contact with the soil for a sufficient period of time to penetrate, soften and cause substantially complete removal of hardened baked-on fatty or proteinaceous soils on cooking units.

Formulation Tables

Concentrate

TABLE I

| | (wt %) | | |
|---|---|---|---|
| | Useful* | Preferred | Most Preferred |
| Rod Micelle | | | |
| Amine oxide | 0–30 | 0–15.0 | 0.5–10 |
| Quaternary amine* | 0–30 | 0–10 | 1–7.5 |
| Anionic aromatic | 0–30 | 0.5–15 | 1–10 |
| Cleaning System | 0.1–50 | 0.5–50 | 0.5–40 |
| Sequestering agent | 0.01–20 | 0.05–10 | 0.1–10 |
| Alkyl glycol ether | 0.01–50 | 1–25 | 1–15 |
| Surfactant | 0.01–10 | 0.05–10 | 0.1–10 |

*The total combined contribution of amine oxide and Quat is at least 1.5 wt %

2 To 25 Vol % Dilution Use Concentrations

TABLE II

| | (wt %) | | |
|---|---|---|---|
| | Useful | Preferred | Most Preferred |
| Rod Micelle | | | |
| Amine oxide | 0–7.5 | 0–3.75 | 0.01–2.5 |
| Quaternary amine | 0–7.5 | 0–2.50 | 0.02–1.88 |
| Anionic aromatic | 0–7.5 | 0.01–3.75 | 0.02–2.5 |
| Cleaning System | 20 ppm–12.5 | 0.01–12.5 | 0.01–10.0 |
| Sequestering agent | 2 ppm–5.0 | 10 ppm–2.5 | 20 ppm–2.5 |
| Alkyl glycol ether | 2 ppm–12.5 | 0.02–6.75 | 0.02–3.75 |
| Surfactant | 2 ppm–7.50 | 10 ppm–2.5 | 20 ppm–2.5 |

EXAMPLES AND TESTING

The following preparations of the thickened alkaline cleaners of the invention are prepared to further illustrate the useful materials falling within the invention concept. The examples show the beneficial properties of the combination of ingredients and disclose the best mode.

Example 1

Into a suitably sized glass beaker equipped with a stirring mechanism was added 308.5 grams of soft water and stirring was initiated. Into the soft water was placed 191.5 grams of a 40 wt % aqueous solution of sodium xylene sulfonate, 233.43 grams of a 29 wt % active aqueous solution of trimethyl-1-hexadecyl ammonium chloride, 20 grams of a 50 wt % active aqueous solution of 2-phosphonobutane-1,2,4-tricarboxylic acid, 100 grams of a 60 wt % active aqueous solution of potassium pyrophosphate, 100 grams of propylene glycol monomethyl ether 50 grams of a 30% active aqueous solution of lauryl dimethyl amine oxide and the contents of the beaker was agitated until uniform. The mixture was a thin uniform liquid. The material was diluted with water to two aqueous compositions of substantially increased viscosity, a first comprising 5% of the composition and a second comprising 10% of the composition and water. Each diluted solution had a viscosity capable of maintaining a sufficient concentration of cleaning materials in contact with soil on a vertical, substantially vertical or slightly inclined surface in a cleaning unit.

Example 2

To 90 grams of the base formula of Example 1 was added 4 grams of a 50 wt % active solution of sodium hydroxide, 5 grams of a 60 wt % active tetrapotassium pyrophosphate and 1 gram of anhydrous $Na_2SiO_3$. The material was a thin liquid.

Example 2A

To 90 grams of the base formula of Example 2 was added 6 grams of a 50 wt % active solution of aqueous sodium hydroxide and 4 grams of $Na_2SiO_3$. The material was a thin liquid.

Example 2B

To 90 grams of the stock material of Example 2 was added 9 grams of a 60 wt % active aqueous tetrapotassium pyrophosphate and 1 gram of crystalline trisodium phosphate.

Example 2C

To 85 grams of the stock gel of Example 2 was added 15 grams of a 60 wt % active tetrapotassium pyrophosphate. The composition was a clear thin liquid.

Example 2D

To 85 grams of the stock gel of Example 2 is added 5 grams of sulfamic acid and 5 grams of phosphoric acid.

Example 2E

To 85 grams of the stock gel of Example 2 is added 10 grams (40 kilo novo units) of Esperase (Novo Industries).

Product Inspections

The pH of a 5 wt % aqueous dilution of the material of Example 2D was 9.59 and the pH of the 10 wt % aqueous dilution of the material was 9.88. The 5 wt % dilution of Example 2D appeared to be a very high viscosity aqueous solution that produced thick strands of gel. The material coated stainless steel panels well. The material dried over a 15 minute period. The 10 wt % aqueous dilution similarly had high viscosity and produced thick gel which completely coated the stainless steel panels. Both the 5 wt % and the 10 wt % aqueous dilution could be rinsed completely with the application of cold service water for 20 seconds.

The cleaning soil removing properties of the compositions of the invention in the following examples were tested on stainless steel panels having a baked-on fatty coating. The panels were prepared by dipping stainless steel panels (7.5 by 5.0 cm.) in a 50% blend of corn oil and soy bean oil. The coated panels were then placed in an oven and baked at 200° C. for 1 hour. The panels after removed from the oven had a brown hard surface coating.

Example 3

Into an appropriately sized glass beaker equipped with a stirring mechanism was placed 1025.6 grams of soft water and the stirring was initiated. Into the stirred soft water was placed 754 grams of a 40 wt % active aqueous solution of sodium xylene sulfonate, 809.6 grams of a 29 wt % active aqueous solution of trimethyl-1-hexadecyl ammonium chloride, 70.4 grams of 2-phosphonobutane-1,2,4-tricarboxylic acid, 105.6 grams of a 40 wt % active aqueous sodium gluconate, 105.6 grams of a 30 wt % active aqueous solution of lauryl dimethylamine oxide, 704 grams of a 50 wt % active aqueous solution of sodium hydroxide, 400 grams of propylene glycol monomethyl ether, 21.2 grams of a nonyl phenol ethoxylate (9.5 moles of ethylene oxide) and 4 grams of fluorescein dye. The materials were agitated until uniform and formed a thin liquid.

Example 3A

Example 3A is repeated but substituting 500 grams of citric acid and 200 grams of sulfamic acid for the 704 grams of the sodium hydroxide solution.

Example 3B

Example 3 is repeated but substituted 200 grams of alpha-amylase (Rapidase, Novo Industries) for the 704 grams of sodium hydroxide solution.

Product Inspections

A series of dilutions of the material of Example 3 in water were made at a dilution of 75 parts of the solution plus 25 parts of water, a dilution of 50 parts of the solution and 50 parts of water, a dilution of 25 parts of the solution and 75 parts of water, and a dilution of 10 parts of the solution plus 90 parts of water. The diluted materials were placed on the coated stainless steel test panels as discussed above. All dilutions including the neat material penetrated and lifted soil within a short time.

Example 4

Into an appropriately sized glass beaker equipped with a mechanical stirrer was added 373.6 grams of soft water. The water was agitated and into the agitated mass was added 188 grams of a 40 wt % active aqueous sodium xylene sulfonate, 202 grams of a 29 wt % active aqueous solution of trimethyl-1-hexadecyl ammonium chloride, 18 grams of a 50 wt % active aqueous solution of 2-phosphonobutane-1,2,4-tricarboxylic acid, 26 grams of a 40 wt % active aqueous solution of sodium gluconate, 26 grams of lauryl dimethylamine oxide, 60 grams of a 50 wt % active aqueous solution of sodium hydroxide, 100 grams of propylene glycol monomethyl ether, 5 grams of nonyl phenol ethoxylate (9.5 moles of ethylene oxide) and 1 grams of fluorescein dye. The contents were stirred and a uniform thin liquid was produced.

Example 4A

To 90 grams of the preparation of Example 4 was added 10 grams of propylene glycol monomethyl ether.

Example 4B

To 90 grams of Example 4 was added 10 grams of lauryl dimethylamine oxide.

Example 4C

To 50 grams of Example 4A was added 50 grams of Example 4B.

Product Inspections

All Examples (4–4C) showed excellent residence time on a vertical panel and cleaning properties. However, Example 4B, containing increased amounts of the propylene glycol monomethyl ether, showed superior soil removing properties when applied in diluted form to the stainless steel panels prepared above.

Example 5

Into an appropriately sized glass beaker was placed 984 grams of soft water. Agitation was initiated and into the agitated water was placed 808 grams of a 29 wt % active trimethyl-1-hexadecyl ammonium chloride, 72 grams of 2-phosphonobutane-1,2,4-tricarboxylic acid, 104 grams of a 40 wt % active aqueous solution of sodium gluconate, 104 grams of lauryl dimethylamine oxide, 704 grams of a 50 wt % active aqueous sodium hydroxide, 20 grams of nonyl phenol ethoxylate (9.5 moles of ethylene oxide), 400 grams of propylene glycol monomethyl ether, 800 grams of a 40 wt % active aqueous sodium xylene sulfonate solution and 4 grams of fluorescein dye. The material was agitated until uniform forming a thin liquid solution. The viscosity of the neat material prepared in Example 5 was measured to be 11 cP measured with a Brookfield LVT viscometer 60 RPM at 70° F. with spindle No. I. C-1.

Example 5A

The material of Example 5 was diluted to a 10 wt % active dilution with water.

Example 5B

The material of Example 5 was diluted to a 5 wt % active solution with water.

Product Inspections

The viscosity of Example 5A was measured to be 79 cP. The viscosity of Example 5B was measured to be about 32 cP. The pH of Example 5A was 13.06. The pH of Example 5B was 12.28.

Example 6

To an appropriately sized glass beaker equipped with a mechanical stirrer was added 32.73 grams by weight of soft water. Stirring was initiated and into the stirred water was placed 17.15 grams of a 40 wt % active aqueous solution of sodium xylene sulfonate, 22.0 grams of a 29 wt % active aqueous solution of trimethyl-1-hexadecyl ammonium chloride, 2 grams of a 50 wt % active aqueous solution of 2-phosphonobutane-1,2,4-tricarboxylic acid, 3 grams of a 40 wt % active solution of sodium gluconate, 3 grams of a 30 wt % active solution of lauryl dimethylamine oxide, 20 grams of 50 wt % active aqueous sodium hydroxide and 0.12 gram of fluorescein dye. The material was agitated until a uniform thin liquid solution was prepared.

Example 6A

To 176 grams of the above preparation was added 4 grams of a 40 wt % active aqueous solution of sodium xylene sulfonate and 20 grams of propylene glycol monomethyl ether.

Example 6B

To 174 grams of Example 6 was added 6 grams of a 40 wt % active aqueous solution of sodium xylene sulfonate and 20 grams of propylene glycol monomethyl ether.

Example 6C

To 172 grams of Example 6 was added 8 grams of a 40 wt % active aqueous solution of sodium xylene sulfonate and 20 grams of propylene glycol monomethyl ether.

Product Inspections

Dilutions of Examples 6, 6A, 6B and 6C to a 5 wt % aqueous dilution resulted in thick viscous solution and good stainless steel coating properties. The dilutions of the material to a 10 wt % dilution provided an adequate though less thick materials that coated well. The undiluted materials of the examples were placed in a 122° F. oven to test for stability. After six days, the preparations of Example 6A through 6C were stable. No separation layer was formed. Example 6 separated into two layers which was returned to homogeneous by five inversions. Materials of the examples and 5 and 10 wt % aqueous dilutions thereof when applied to coated stainless steel panels shown above provided rapid soil softening and removal.

Example 7

Solvent-Viscosity Effect 4000 grams of the following formulae were prepared:

Example 7A

| | Wt % | Wt |
|---|---|---|
| Soft Water | 27.33 | 1093.20 |
| Solvent | 00.00 | 00.00 |
| SXS-40% (Na-xylene sulfonate) | 22.22 | 888.80 |
| Bayhibit AM (phosphonate) | 2.00 | 80.00 |
| Sodium Hydroxide 50% | 19.56 | 782.40 |
| Sodium Gluconate 40% | 2.89 | 115.60 |
| Supra 2 (amine oxide) | 2.89 | 115.60 |
| NPE 9.5 (nonyl phenol ethoxylate) | 0.56 | 22.40 |
| Fluorescein Dye | 0.11 | 4.40 |
| Arquad 16–29 (Quat) | 22.44 | 897.60 |
| | 100.0% | 3999.609 |

Example 7B

Fifty grams formula A combined with 450 grams soft water.

Example 7C

With the above formula A the following solvents were combined at 50.0 grams of Formula A with 1.00 grams and 5.00 grams of each solvent tested for an equivalent wt % basis of the solvents of 1.96% and 9.0%. These combinations of formula A with the solvents were added to 450.0 grams of soft water. The resulting solutions were cooled to 70° F. (21° C.) and the viscosities determined with a Brookfield LVT Model Viscometer with 60 rpm using the spindle C1. The following is a summary of the testing results.

10% Formula A Viscosity With Base Equivalent Wt % Solvent

Examples 7B–I

| Solvent Additive | 0.00 | 1.96% | 9.09% |
|---|---|---|---|
| B 10% Formula A Without Solvent | 92 cps | — | — |
| C Ethylene Glycol Butyl Ether | | 58 cps | 14 cps |
| D Diethylene Glycol Butyl Ether | | 64 cps | 16 cps |
| E Diethylene Glycol Methyl Ether | | 99 cps | 84 cps |
| F Propylene Glycol Methyl Ether | | 92 cps | 70 cps |
| G Propylene Glycol n-Butyl Ether | | 45 cps | 8 cps |
| H Isopropyl Alcohol (99.9%) | | 81 cps | 46 cps |
| I Tripropylene Glycol Methyl Ether | | 87 cps | 52 cps |

Example 8

In order to check performance of the following solutions for soil removal in actual use situations several 316 stainless steel panels were placed in a commercial production oven for the duration of an 18 hour production shift. The unit was a Stein Jet Sweep Oven in which battered chicken patties were cooked at 525° F.

Example 8A

The following solution was prepared in an appropriate size beaker with stirring while adding the materials.

| | Wt % | Wt |
|---|---|---|
| Soft Water | 27.33 | 1092.2 g |
| SXS-40% | 22.22 | 888.80 g |
| Bayhibit AM | 2.0 | 80.0 g |
| Sodium Gluconate | 2.89 | 115.6 g |
| Supra 2 | 2.89 | 115.6 g |
| 50% NaOH | 19.56 | 782.0 g |
| NPE 9.5 | 0.56 | 22.4 g |
| Fluorescein dye | 0.11 | 4.4 g |
| Arquad 16–29 | 22.44 | 897.6 g |

Example 8B

With Solution 8A the following solution was prepared in an appropriate size beaker with stirring while adding the materials

| | Wt % | Wt |
|---|---|---|
| Formula 8A | 90.0 | 450.0 g |
| Propylene Glycol Methyl Ether | 10.0 | 50.0 g |

Example 8C

With solution 8A the following solution was prepared in an appropriate size beaker with stirring while adding the materials

| | Wt % | Wt |
|---|---|---|
| Formula 8A | 90.0 | 450.0 g |
| Diethylene Glycol Methyl Ether | 10.0 | 50.0 g |

Example 8D

With solution 8B the following solution was prepared in an appropriate size beaker with stirring while adding the materials

| | Wt % | Wt |
|---|---|---|
| Formula 8B | 25.0 | 200.0 g |
| Soft Water | 75.0 | 600.0 g |

Example 8E

With solution 8C, the following solution was prepared in an appropriate size blender with stirring while adding the materials

| | Wt % | Wt |
|---|---|---|
| Formula 8C | 25.0 | 200.0 g |
| Soft Water | 75.0 | 600.0 g |

Example 8F

The Stein JSO unit soil panels, prepared above, were attached to a vertical stainless wall and solution 8D was sprayed over them through a hand pumped 1.500 liter spray bottle. After thirty minutes of exposure to the 8D solution, the panels were rinsed with a low pressure spray of 140° F. water. The soil on the panels were sprayed with the 140° F. water for twenty seconds. At this time the panels were found to be 90% clean revealing a bare metal surface.

Example 8G

The Stein JSO unit soil panels were attached to a vertical stainless steel wall and solution 8E was sprayed over them through a hand pumped 1.500 liter spray bottle. After thirty minutes of exposure to the 8E solution, the panels were rinsed with 140° F. low pressure water for twenty seconds. The panels were found to be 80% clean to a bare metal surface.

Example 9

The following solutions were prepared in an appropriate size beaker with stirring while adding the materials Example 9A

| | Wt % | Wt |
|---|---|---|
| Soft Water | 25.64 | 1025.6 g |
| SXS-40% | 18.85 | 754.0 g |
| Dowanol PM | 10.00 | 400.0 g |
| Bayhibit AM | 1.76 | 70.4 g |
| Sodium Gluconate 40% | 2.64 | 105.6 g |
| Supra 2 | 2.64 | 105.6 g |
| Sodium Hydroxide 50% | 17.60 | 704.0 g |
| NPE 9.5 | 0.53 | 21.2 g |
| Arquad 16–29 | 20.24 | 809.6 g |
| Fluorescein Sodium Dye | 0.10 | 4.0 g |

Example 9B

| | Wt % | Wt |
|---|---|---|
| Soft Water | 37.36 | 373.6 g |
| SXS-40% | 18.80 | 188.00 g |
| Dowanol PM | 10.00 | 100.0 g |
| Bayhibit AM | 1.80 | 18.00 g |
| Sodium Gluconate 40% | 2.60 | 26.00 g |
| Supra 2 | 2.60 | 26.00 g |
| Sodium Hydroxide 50% | 6.00 | 60.00 g |
| NPE 9.5 | 0.50 | 5.00 g |
| Arquad 16-29 | 20.24 | 202.40 g |
| Fluorescein Sodium Dye | 0.10 | 1.0 g |

Example 9C

With solution B above, the following solution was prepared.

| | Wt % | Wt |
|---|---|---|
| Formula B (8730-7-1) | 90.0 | 90.0 g |
| Monoethanolamine 99% | 10.0 | 10.0 g |

Example 9D

With Formula 9A, 10.0 grams was added to 90.0 grams soft water. The resulting solution was a thick viscous gel.

Example 9E

With Formula 9C, 10.0 grams was added to 90.0 grams soft water. The resulting solution was a thick viscous gel.

Example 9 D and E Testing

Soil test panels were prepared by dipping 7.5 cm×5.0 cm stainless steel panels in a mixture of 50% corn oil and 50% soy oil. The oil coated panels were then laid horizontal in a constant temperature oven and baked for 60 minutes at 200° C. The above described panels were heated to 250° F. (121° C.) on a hot plate and solution 9D and 9E were tested for soil removal performance. Both solutions produced almost instantaneous cleaning of the stainless steel panel to bare metal.

Example 10

In an appropriate size mixer, the following formula was prepared at a batch size of 110 gallons-466.3 kilograms.

Formula 10

| Description | Formula (%) | Wt (kilograms) |
|---|---|---|
| Soft Water | 24.60 | 114.71 |
| Sodium Hydroxide 50% | 17.60 | 82.07 |
| Dowanol PM | 10.00 | 46.63 |
| Sodium Xylene Sulfonate 40% | 20.00 | 93.26 |
| Supra 2 | 2.60 | 12.12 |
| NPE 9.5 | 0.50 | 2.33 |
| Arquad 16-29 | 20.20 | 94.20 |
| Sodium Gluconate 40% | 2.60 | 12.12 |
| Bayhibit AM | 1.80 | 8.39 |
| Fluorescein Dye | 0.10 | 0.47 |
| | 100.00 | 466.3 |

With the above prepared sample of Formula 10, the following solution was prepared.

| | Wt % | Wt |
|---|---|---|
| Formula | 15.0 | 2839 g |
| 132° F. (55.6° C.) Service Water | 85.0 | 16,086 g |

The above prepared solution was added to a fifteen gallon stainless steel pressure vessel which was designed for foam application. The foam applicator has a constant air supply and an air pressure regulator. The foam applicator also has separate control knobs to regulate the air and liquid ratio that flows out of the tank into the application hose. The solution temperature was read prior to pressurization of the tank and was 121.4° F. The tank was pressurized with air to 67 psi. The application hose flow lever was turned to an open position and the air and liquid control knobs were used to adjust the solution stream to a thick rich foam. This foam was applied to a vertical stainless steel wall. The foam coated the wall by flowing down to a uniform coating thickness of one half to one quarter inch (1.27 to 0.63 cm). The foam was allowed to remain on the wall for twenty minutes. The foam at this time was observed to still coat 95% of the wall surface area with a layer of one quarter to one eighth inch thick.

The above specification, examples and data provide a base for understanding the technical disclosure. However, since many embodiments of the invention can be made without departing from the spirit and scope of the invention, the invention resides in the claims hereinafter appended.

We claim:

1. A method of cleaning a food preparation unit having at least one substantially vertical surface having a baked food soil coating, the method comprising:

(i) contacting the soil with a composition that is effective to adhere to the vertical surface for a period of time necessary to soften the soil for removal, the composition comprising, in an aqueous medium:

(a) an effective amount of a rod micelle thickener composition sufficient to thicken the cleaner composition;

(b) an effective cleaning amount of a lower alkyl glycol ether solvent;

(c) an effective cleaning amount of a source of alkalinity; and (d) a hardness sequestering agent;

the cleaning composition having a viscosity of at least 20 cP using a Brookfield LVT viscometer with a number C1 spindle at 60 rpm and at 21° C., to form a softened soil; and (ii) removing the softened soil.

2. The method of claim 1 wherein the period of time necessary to soften the soil for removal is at least 5 minutes.

3. The method of claim 2 wherein a substantial proportion of the material of claim 2 remains in contact with the soil for greater than about 20 minutes.

4. The method of claim 1 wherein the rod micellar thickener composition comprise an amine oxide and a quaternary ammonium compound and an anionic counterion, wherein there is about 0.1 to 10 parts of amine oxide per part of quaternary ammonium compound.

5. The method of claim 1 wherein the rod micellar thickener composition additionally comprises an anionic aromatic counterion.

6. The method of claim 5 wherein the anionic aromatic counterion comprises a sulfonate composition, a salicylate composition, a tosylate composition or mixtures thereof.

7. The method of claim 1 wherein the hardness sequestering agent comprises an organic hardness sequestering agent selected from the group consisting of an organic phosphonate, an alkali metal gluconate, and mixtures thereof.

8. The method of claim 1 wherein the source of alkalinity comprises an alkali metal hydroxide, an alkali metal silicate, an alkali metal phosphate or mixtures thereof.

* * * * *